US006200195B1

(12) United States Patent
Furuno et al.

(10) Patent No.: US 6,200,195 B1
(45) Date of Patent: Mar. 13, 2001

(54) ADHESIVE PAD AND METHOD FOR ITS PRODUCTION

(75) Inventors: Kunio Furuno, Kyoto; Kenji Inagaki, Kobe, both of (JP)

(73) Assignee: Yoshimoto Club Co., Ltd., Osaka-fu (JP)

( * ) Notice: Subject to any disclaimer, the term of this patent is extended or adjusted under 35 U.S.C. 154(b) by 0 days.

(21) Appl. No.: 09/271,114

(22) Filed: Mar. 17, 1999

(30) Foreign Application Priority Data

Mar. 17, 1998 (JP) ..... 10-110034
Feb. 25, 1999 (JP) ..... 11-048382

(51) Int. Cl.[7] ..... A41C 3/00
(52) U.S. Cl. ..... 450/81
(58) Field of Search ..... 450/37, 56, 55, 450/81, 57, 52, 39; 128/890; 604/387; 2/104, 56, 58, 267; 428/447

(56) References Cited

U.S. PATENT DOCUMENTS 2,292,024 * 8/1942 Dreher ..... 450/81
2,727,278 * 12/1955 Thompson ..... 18/59
2,793,369 * 5/1957 Panighini ..... 2/42
3,202,565 * 8/1965 Loftin ..... 161/73
3,276,449 * 10/1966 Morgan ..... 450/81
4,333,471 * 6/1982 Nakai ..... 450/81
4,553,550 * 11/1985 Hattori ..... 450/81
4,640,288 * 2/1987 Hattori ..... 450/81
4,838,253 * 6/1989 Brassington et al. ..... 128/156
5,171,321 * 12/1992 Davis ..... 623/7
5,216,069 * 6/1993 Kobori ..... 524/588
5,312,690 * 5/1994 Fukuda et al. ..... 428/447
5,451,440 * 9/1995 Tynan, Jr. ..... 428/40
5,599,894 * 2/1997 Ikeno ..... 528/15
5,602,214 * 2/1997 Lin et al. ..... 525/478
5,631,082 * 5/1997 Hirose et al. ..... 428/343
5,743,272 * 4/1998 Kocher, Jr. ..... 128/846
5,776,614 * 7/1998 Cifuentes et al. ..... 428/447
5,782,672 * 7/1998 Woodley ..... 450/57
5,789,084 * 8/1998 Nakamura et al. ..... 428/447
5,916,981 * 6/1999 Cifuentes et al. ..... 525/477
5,942,332 * 8/1999 Nadamura et al. ..... 428/447

OTHER PUBLICATIONS

FRP Molding Technique, p. 248, May 1976.

* cited by examiner

*Primary Examiner*—John J. Calvert
*Assistant Examiner*—Alissa L. Hoey
(74) *Attorney, Agent, or Firm*—Knobbe, Martens, Olson & Bear, LLP

(57) ABSTRACT

The present invention provides a low irritant adhesive pad which can retain its adhesion for a repeated use, and a process for its production. The adhesive pad 1 of the invention is used as stuck on the human body and comprises a pad body 2 made of a silicone rubber, and a silicone gel adhesive layer 3 integrally formed on the pad body to provide an adhesive surface.

9 Claims, 2 Drawing Sheets

ADHESIVE PAD AND METHOD FOR ITS PRODUCTION

BACKGROUND OF THE INVENTION

The present invention relates to adhesive pads to be used as stuck on the human skin, and processes for their production.

Known adhesive pads of this type include, for example, nipple covers which usually comprise a cup-shaped body and an adhesive layer formed on the edge of the inside surface of the body (Unexamined Japanese Utility Model Publication No. 143508/1988).

However, adhesive layers of the conventional adhesive pads are formed with adhesive for sticking plasters, and thus are likely to cause skin irritation. Further, after being stuck to the skin and removed, they cannot be used again because their adhesion is reduced or lost. Therefore, such adhesive pads are uneconomical.

The object of the present invention is to provide, for solving the above problems, a low-irritant adhesive pad which retains its adhesion after removing from the skin and thus can be used repeatedly.

SUMMARY OF THE INVENTION

The present invention provides an adhesive pad to be used as stuck on the human body comprising a pad body made of a silicone rubber, and a silicone gel adhesive layer integrally formed on the pad body to provide an adhesive surface.

The process for preparing the adhesive pad according to the present invention comprises the steps of molding an uncured silicone rubber into a desired shape, semi-curing the molded rubber by heating, forming a layer of an uncured silicone gel on the semi-cured silicone rubber to provide an adhesive surface, and curing the silicone gel and silicone rubber.

The objects and features of the invention will be described in detail with reference to the following accompanying drawings.

DETAILED DESCRIPTION OF THE PREFERRED EMBODIMENTS

Figure 1:
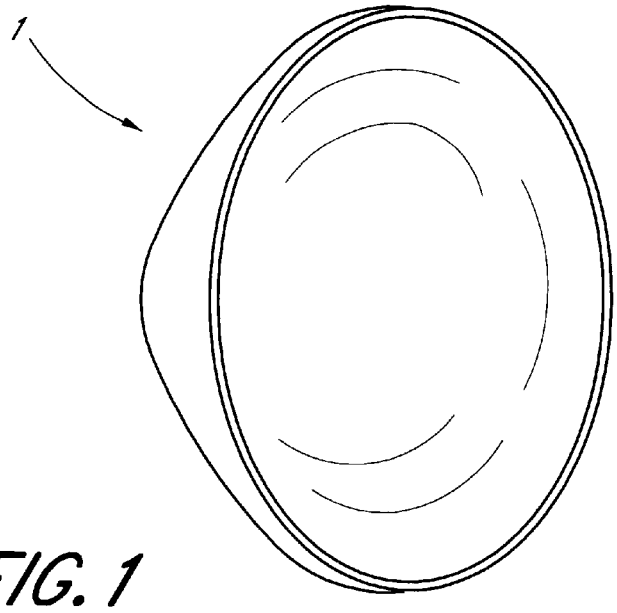
FIG. 1 is a perspective view showing an embodiment of the adhesive pad of the invention.
Figure 2:
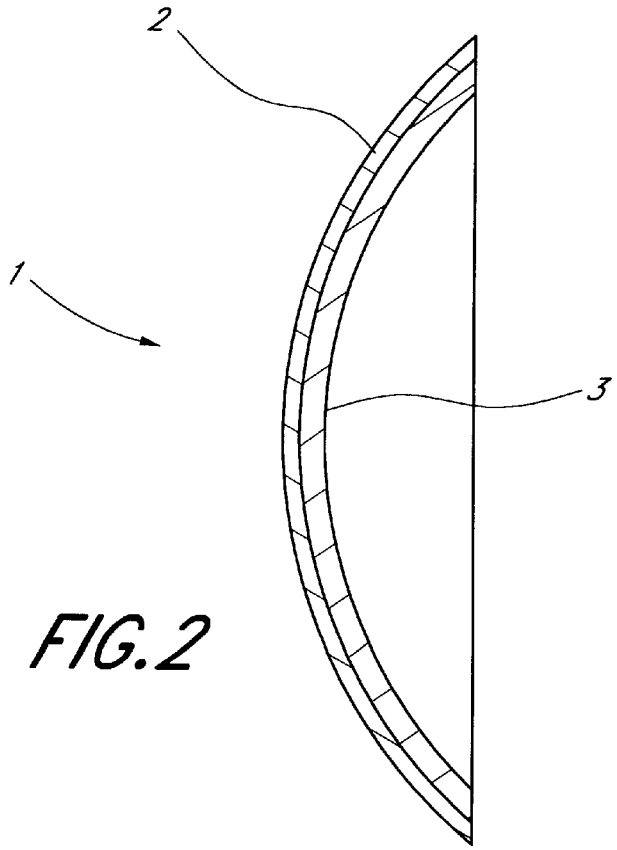
FIG. 2 is an enlarged sectional view of the adhesive pad of FIG. 1.
Figure 3A:
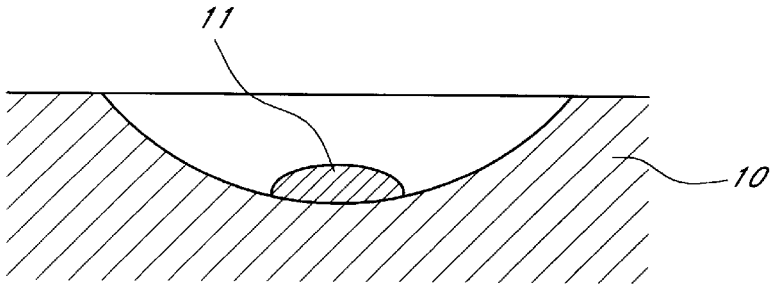
FIG. 3 is shows the process for producing the adhesive pad of FIG. 1.
Figure 3B:
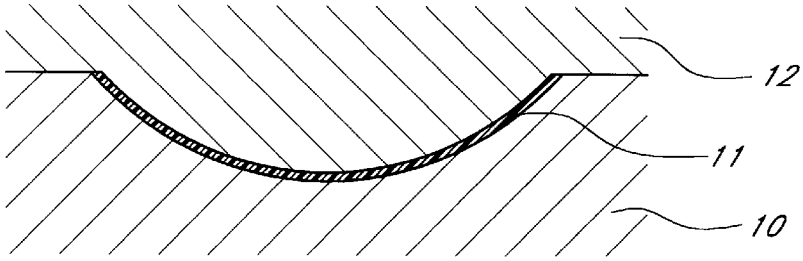
Figure 3C:
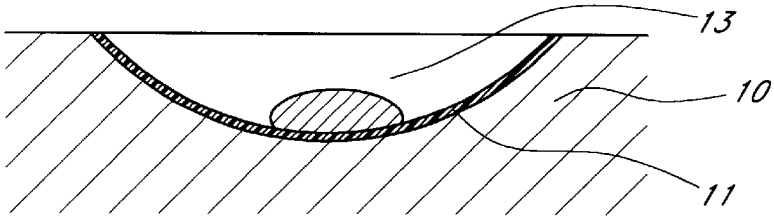
Figure 3D:
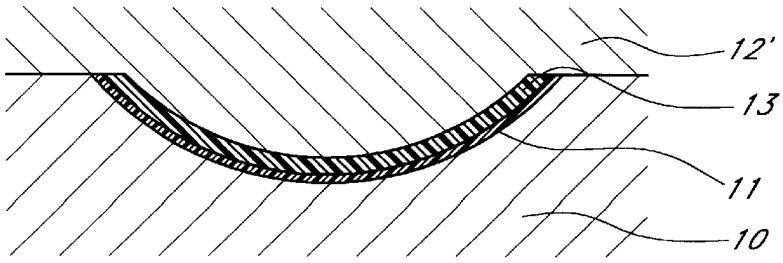

Referring to FIGS. 1 and 2, the pad of an embodiment of the invention has a cup-like shape for use as a nipple cover.

The adhesive pad 1 comprises a cup-shaped body 2 made of a silicone rubber, and a silicone gel adhesive layer 3 integrally formed on the concave surface of the body 2. In the adhesive pad 1 of this type, the body 2 is preferably 0.2 to 0.6 mm thick and the silicone gel adhesive layer 3 is preferably 1.5 to 2.5 mm thick, so that the adhesive pad is unbulky, and comfortable when stuck on the skin. The body 2 has a diameter sufficient to cover the nipple area, i.e., a diameter of preferably 35 to 65 mm, more preferably 45 to 55 mm.

If the silicone gel adhesive layer 3 is attached to the silicone rubber body 2 only by its adhesion, the adhesive layer 3 is liable to separate from the body 2 and is not suitable for repeated use.

Accordingly, the following process is employed to produce an adhesive pad which has a silicone gel layer 3 unlikely to separate, and thus is suitable for practical use. Described below with reference to FIG. 3 is a process for preparing the above-mentioned adhesive pad for use as a nipple cover.

First, a predetermined amount of an uncured silicone rubber 11 is fed into the cup-shaped concavity of a lower mold 10 (FIG. 3(*a*)). Usable in this process are various known high temperature-curing silicone rubbers, such as "SE1187" (a product of Toray Dow Corning Silicone Co., Ltd.). Silicone rubbers of this type are free of adhesion after curing. Although this embodiment employs a cup-shaped mold, molds of various shapes are usable according to the types of pads to be produced, for example, knee pads, elbow pads, etc.

Subsequently, an upper mold 12 is pressed against the silicone rubber 11 on the lower mold 10 to form the silicone rubber 11 into a predetermined cup-like shape, and the silicone rubber 11 is semi-cured by heating (primary curing; FIG. 3(*b*)). The temperature and time for heating the silicone rubber 11 vary according to the kind of silicone rubber employed, but are usually 160 to 180° C. and about 10 to 20 minutes, respectively. The semi-cured silicone rubber 11 has a certain degree of retention of shape, and thus can be prevented from breaking when molded into a thin sheet as described above. The convexity and concavity of the upper mold 12 and lower mold 10 have such radii of curvature that the two molds form a predetermined space between them when the upper mold 12 is pressed against the lower mold 10.

Then, the upper mold 12 is lifted, and a predetermined amount of an uncured silicone gel 13 is poured on the semi-cured, cup-shaped silicone rubber 11, using, for example, a dispensing machine (FIG. 3(*c*)). The silicone gel 13 may be any silicon gel material having sufficient adhesion and a penetration of 40 to 100, preferably 50 to 60, when cured (determined according to JIS (Japanese Industrial Standard) K2220). Usable silicon gels include known room temperature-curing or heat-curing silicone gels, such as "SE1886A/B" (a product of Toray Dow Corning Silicone Co., Ltd.); "K-104 Gel" and "KE1052 (A-B)" (products of Shin-Etsu Chemical Co., Ltd.); and "YE5818" (a product of Toshiba Silicone Co., Ltd.). In advance of the above procedures, an release agent is applied to the upper mold 12 to facilitate release of the upper mold from the silicone rubber 11.

Then, a second upper mold 12' having a radius of curvature smaller than that of the upper mold 12 is pressed against the silicone gel 13 on the semi-cured silicone rubber 11 to form the silicone gel 13 into a layer. The molded article is heated again until the semi-cured silicone rubber 11 has been cured to an optimum degree (secondary curing), to thereby form a pad body made of a silicone rubber and a silicone gel adhesive layer having a desired penetration and adhesion (FIG. 3(*d*)). Conditions for secondary curing vary according to the kinds of silicon rubber and silicone gel employed, but the curing is performed usually at 150 to 170° C. for about 20 to 30 minutes. Then the upper mold is lifted and the molded article is released from the lower mold 10 to obtain an adhesive pad.

In the adhesive pad thus obtained, the silicone gel adhesive layer is integrally formed on the silicone rubber pad body, so that the boundary of the two materials is indistinct. Experiments revealed that the adhesive pad retains its adhesion in a degree suitable for use even if washed with water 50 times. Moreover, silicones are generally low irritant to the skin, and thus the adhesive pad is suitable for use on the human skin.

Further, since the silicon rubber and silicone gel can be molded in the same lower mold 10, the above production process saves production costs, and decreases the production time because the number of production steps reduces.

As is clear from the above, the adhesive pad of the invention is low irritant to the skin, and can be washed with water and used repeatedly. Further, the production process of the invention can produce, at a low cost, an adhesive pad comprising a silicone rubber layer and a silicone gel layer formed integrally with each other.

The foregoing describes several preferred embodiments of the present invention. Modifications obvious to those skilled in the art can be made thereto without departing from the scope of the invention.

What is claimed is:

1. A repeatedly usable, washable adhesive molded pad to adhere to the human body comprising a pad body made of a silicon rubber, and a silicon gel adhesive layer integrally formed on the pad body to provide an adhesive surface, said pad body and said silicon gel adhesive layer being cured and seamlessly joined, the adhesion of said silicon gel adhesive layer being retained after being washed with water 25 times.

2. The adhesive pad according to claim 1 wherein the pad body has a cup-like shape having a concave surface for use as a nipple cover and wherein the silicone gel adhesive layer is provided on the concave surface of the pad body.

3. The adhesive molded pad according to claim 1, wherein said pad has a thickness of 0.2–0.6 mm, and said silicon gel adhesive layer has a thickness of 1.5–2.5 mm, integrated.

4. The adhesive molded pad according to claim 1, which consists of said pad body and said silicon gel adhesive layer.

5. The adhesive molded pad according to claim 1, wherein the adhesion of said silicon gel adhesive layer is retained after being washed with water 50 times.

6. A repeatedly usable, washable adhesive molded pad to adhere to the human body comprising a pad body made of a silicon rubber, and a silicon gel adhesive layer integrally formed on the pad body to provide an adhesive surface, said pad body and said silicon gel adhesive layer being concurrently cured and seamlessly joined, said silicon gel adhesive layer having a thickness greater than that of said pad body.

7. The adhesive molded pad according to claim 6, wherein said pad has a thickness of 0.2–0.6 mm, and said silicon gel adhesive layer has a thickness of 1.5–2.5 1 mm, integrated.

8. The adhesive molded pad according to claim 6, which consists of said pad body and said silicon gel adhesive layer.

9. The adhesive molded pad according to claim 6, wherein the adhesion of said silicon gel adhesive layer is retained after being washed with water 50 times.

* * * * *

UNITED STATES PATENT AND TRADEMARK OFFICE

CERTIFICATE OF CORRECTION

PATENT NO. : 6,200,195 B1
DATED : March 13, 2001
INVENTOR(S) : Kunio Furuno et al.

It is certified that error appears in the above-identified patent and that said Letters Patent is hereby corrected as shown below:

Column 4,
Line 20, please delete "1.5-2.5 1 mm" and insert -- 1.5-2.5 mm --.

Signed and Sealed this

Twenty-third Day of September, 2003

JAMES E. ROGAN
*Director of the United States Patent and Trademark Office*